US009543713B2

(12) United States Patent
Shimizu

(10) Patent No.: US 9,543,713 B2
(45) Date of Patent: Jan. 10, 2017

(54) VEHICLE-SIDE CONNECTOR WITH A RELAY-CIRCUIT UNIT

(71) Applicant: Sumitomo Wiring Systems, Ltd., Yokkaichi, Mie (JP)

(72) Inventor: Tooru Shimizu, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/775,761

(22) PCT Filed: Mar. 19, 2013

(86) PCT No.: PCT/JP2013/057874
§ 371 (c)(1),
(2) Date: Sep. 14, 2015

(87) PCT Pub. No.: WO2014/147756
PCT Pub. Date: Sep. 25, 2014

(65) Prior Publication Data
US 2016/0028197 A1 Jan. 28, 2016

(51) Int. Cl.
*H01R 13/66* (2006.01)
*H01R 13/70* (2006.01)

(52) U.S. Cl.
CPC ..... *H01R 13/70* (2013.01); *H01R 13/6616* (2013.01); *H01R 2201/26* (2013.01)

(58) Field of Classification Search
CPC ..... H01R 13/5227; H01R 13/6616; H01R 13/6625; H01R 13/6641; H01R 13/665
(Continued)

(56) References Cited

U.S. PATENT DOCUMENTS 5,458,496 A * 10/1995 Itou ..... B60L 11/1846 439/34
2006/0125240 A1* 6/2006 Kato ..... F02N 11/04 290/31

(Continued)

FOREIGN PATENT DOCUMENTS

JP 63-73597 4/1988
JP 4856290 11/2011

(Continued)

OTHER PUBLICATIONS

International Search Report.

*Primary Examiner* — Abdullah Riyami
*Assistant Examiner* — Thang Nguyen
(74) *Attorney, Agent, or Firm* — Gerald E. Hespos; Michael J. Porco; Matthew T. Hespos

(57) ABSTRACT

A vehicle-side connector (10) is connected to a battery mounted in a vehicle. The vehicle-side connector (10) includes a housing (20) configured such that a charging connector (80) is connected thereto. Vehicle-side terminals (40) individually are accommodated in cavities (28) in the housing (20) and are configured to be connected individually to charging terminals (83) in the charging connector (80) when the housing (20) and a charging-side fitting portion (81) in the charging connector (80) are connected. A resistance circuit unit (60) is accommodated in an accommodating portion (33) in the housing (20) and has a relay terminal (63) is arranged on a left side connected to a vehicle-side signal terminal (40B) and a relay terminal (63) is arranged on a right side connected to a vehicle-side ground terminal (40C).

7 Claims, 18 Drawing Sheets

(58) Field of Classification Search
USPC ..... 439/620.04, 620.13, 205; 320/109, 304, 320/310
See application file for complete search history.

(56) References Cited

U.S. PATENT DOCUMENTS

| | | | | |
|---|---|---|---|---|
| 2011/0288451 | A1 | 11/2011 | Sanai et al. | |
| 2012/0258617 | A1* | 10/2012 | Osawa | H01R 13/5227 439/205 |
| 2012/0295460 | A1* | 11/2012 | Ichio | H01R 13/5208 439/205 |
| 2012/0318783 | A1 | 12/2012 | Kamachi | |
| 2015/0343914 | A1* | 12/2015 | Osawa | B60L 11/1818 439/205 |

FOREIGN PATENT DOCUMENTS

| | | |
|---|---|---|
| JP | 2012-221612 | 11/2012 |
| JP | 2013-5520 | 1/2013 |

* cited by examiner

VEHICLE-SIDE CONNECTOR WITH A RELAY-CIRCUIT UNIT

BACKGROUND

1. Field of the Invention

The present invention relates to a vehicle-side connector.

2. Description of the Related Art

A vehicle-side connector to be connected to an end of a wire extending from a battery mounted in a vehicle is known, for example, from Japanese Unexamined Patent Publication No. 2012-221612. A charging connector connected to a power supply is connectable to this vehicle-side connector and the battery is charged by properly connecting the vehicle-side connector and the charging connector.

Further, a plurality of wires are drawn out from the vehicle-side connector and a relay circuit including a resistor is provided among these wires. When the vehicle-side connector and the charging connector are connected, the relay circuit is closed and a predetermined voltage value corresponding to the resistor is transmitted to a controller on a vehicle side, whereby a connected state of the vehicle-side connector and the charging connector is detected. Such a technology is described in Japanese Unexamined Patent Publication No. 2013-5520.

In the case of constructing a relay circuit including an electronic component such as a resistor as described above, the electronic component is soldered and molded between wires such as a ground line and a signal line drawn out from the vehicle-side connector. Thus, man-hours for constructing the relay circuit are increased. Further, since a mounting space for the vehicle-side connector is limited with the enlargement of the battery, space saving of the relay circuit has been desired.

The present invention was completed based on the above situation and an object thereof is to reduce man-hours for constructing a relay circuit and realize space saving of the relay circuit.

SUMMARY

To achieve the above object, the present invention is directed to a vehicle-side connector to be connected to a battery mounted in a vehicle, including a housing configured such that a charging connector is connected thereto, a plurality of vehicle-side terminals individually accommodated into a plurality of cavities provided in the housing and configured to be individually connected to a plurality of charging terminals provided in the charging connector when the housing and the charging connector are connected, and a relay circuit unit accommodated in an accommodating portion provided in the housing and having one end connected to one of the plurality of vehicle-side terminals and the other end connected to the vehicle-side terminal different from that connected to the one end out of the plurality of vehicle-side terminals.

According to the vehicle-side connector thus configured, a relay circuit can be provided between one of the plurality of vehicle-side terminals and the vehicle-side terminal different from the one vehicle-side terminal by accommodating the relay circuit unit into the housing. In this way, man-hours for constructing the relay circuit can be reduced, for example, as compared with the case where the relay circuit is constructed between wires drawn out from the vehicle-side connector.

Further, since the relay circuit unit is accommodated into the accommodating portion of the housing, space saving of the relay circuit can be realized as compared with the case where the relay circuit is provided between the wires drawn out from the vehicle-side connector.

The following configurations are preferable as embodiments of the present invention.

The accommodating portion may be provided between the cavities in the housing.

According to such a configuration, the accommodating portion is provided in a space between the cavities, which is a dead space, in the housing. Thus, the housing can be miniaturized, for example, as compared with the case where the accommodating portion is provided on an outer surface of the housing.

The relay circuit unit may include an electronic component with a pair of leads, a first relay terminal to be connected to one of the leads and a second relay terminal to be connected to the other lead, and the leads may be pressed by pressing portions provided in the accommodating portion to be respectively connected to lead connecting portions provided on the first and second relay terminals when the relay circuit unit is accommodated into the accommodating portion.

According to such a configuration, the first and second relay terminals are connected to the electronic component to construct the relay circuit unit only by accommodating the relay circuit unit into the accommodating portion. This can facilitate a connecting operation of the leads and the lead connecting portions as compared with the case where each relay terminal is soldered or crimped to the lead of the electronic component. Consequently, man-hours for connecting the leads and the lead connecting portions can be reduced.

The lead connecting portion may include a pressure contact blade to be brought into pressure contact with the lead pushed by being pressed by the pressing portion.

According to such a configuration, the structure of the lead connecting portion can be simplified and miniaturized as compared with the case where the lead connecting portion is provided with a resilient contact piece or the like to be resiliently brought into contact with the lead.

The first and second relay terminals may include a terminal connecting portion protruding into the cavity and resiliently displaceable, and the terminal connecting portion may resiliently come into contact with the vehicle-side terminal when the vehicle-side terminal is accommodated into the cavity.

According to such a configuration, each relay terminal and the vehicle-side terminal can be connected only by accommodating the vehicle-side terminal into the cavity of the housing. This enables each relay terminal and the vehicle-side terminal to be easily connected and man-hours for connecting each relay terminal and the vehicle-side terminal can be reduced, for example, as compared with the case where the relay terminal and the vehicle-side terminal are connected by soldering or crimping.

The first and second relay terminals may include a linking portion linking the lead connecting portion and the terminal connecting portion, and a press-fit projection to be press-fitted into the housing may be provided on the linking portion.

According to such a configuration, the press-fit projection is provided on the linking portion. Thus, the structure of the relay terminal can be simplified and miniaturized as compared with the case where a press-fit piece to be press-fitted into the housing is separately provided.

The electronic component may be a resistor, the vehicle-side terminal to be connected to the first relay terminal may be a vehicle-side ground terminal, and the vehicle-side terminal to be connected to the second relay terminal may be a vehicle-side signal terminal.

According to such a configuration, a resistance circuit can be provided between the vehicle-side ground terminal and the vehicle-side signal terminal without connecting the resistor between a ground line connected to the vehicle-side ground terminal and a signal line connected to the vehicle-side signal terminal using solder or the like.

The first and second relay terminals may be identically shaped.

According to such a configuration, the first and second relay terminals can be used as common parts. This can prevent the mix-up of the first and second relay terminals and is advantageous in terms of parts management.

According to the present invention, it is possible to reduce man-hours for constructing a relay circuit and realize space saving of the resistance circuit.

DETAILED DESCRIPTION

One embodiment of the present invention is described with reference to FIGS. 1 to 21.

This embodiment concerns a vehicle-side connector 10 to be connected to a battery (not shown) mounted in a vehicle, and the battery is charged by properly connecting a charging connector 80 connected to a power supply to this vehicle-side connector 10 and applying power.

Figure 3:
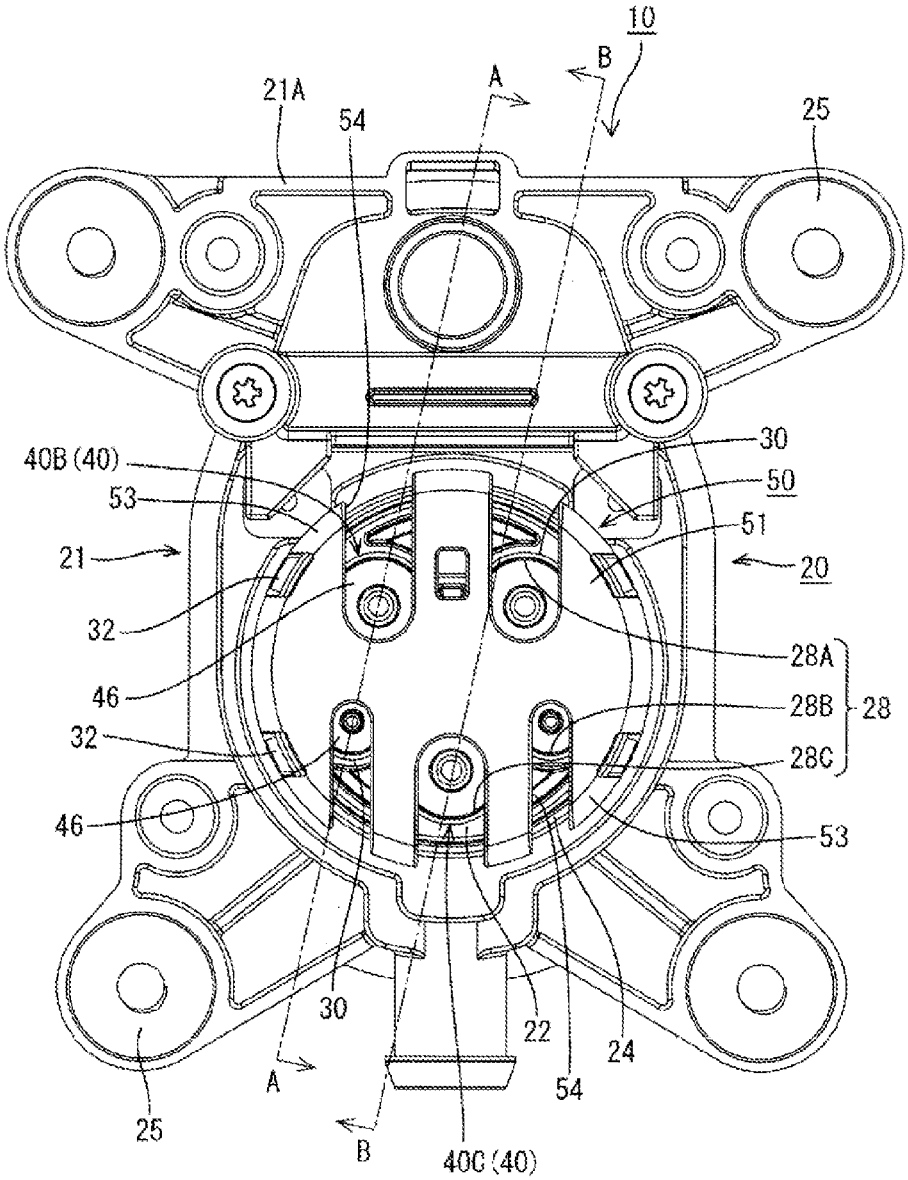
FIG. 3 is a rear view of the vehicle-side connector.

Note that, in the following description, a vertical direction is based on a vertical direction in FIG. 3. Further, a front-back direction is based on a lateral direction in FIG. 4 and sides of the two connectors 10, 80 to be connected to each other are referred to as front sides on the basis of a connecting direction of the connectors 10, 80.

Figure 21:
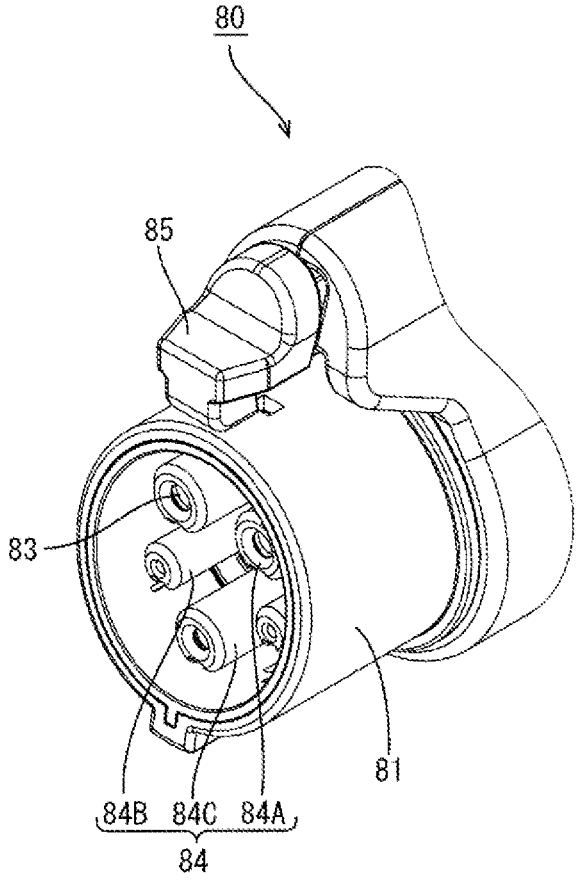
FIG. 21 is a perspective view of a charging connector obliquely viewed from front.

As shown in FIG. 21, the charging connector 80 is provided with a hollow cylindrical charging-side fitting portion 81 fittable into the vehicle-side connector 10. Terminal accommodating tube portions 84 in which charging terminals 83 are individually accommodated are formed in three upper, middle and lower rows inside the charging-side fitting portion 81, wherein two in the upper row are power supply terminal accommodating tube portions 84A, two in the middle row are signal terminal accommodating tube portions 84B and one in the center of the lower row is a ground terminal accommodating tube portion 84C.

Figure 4:
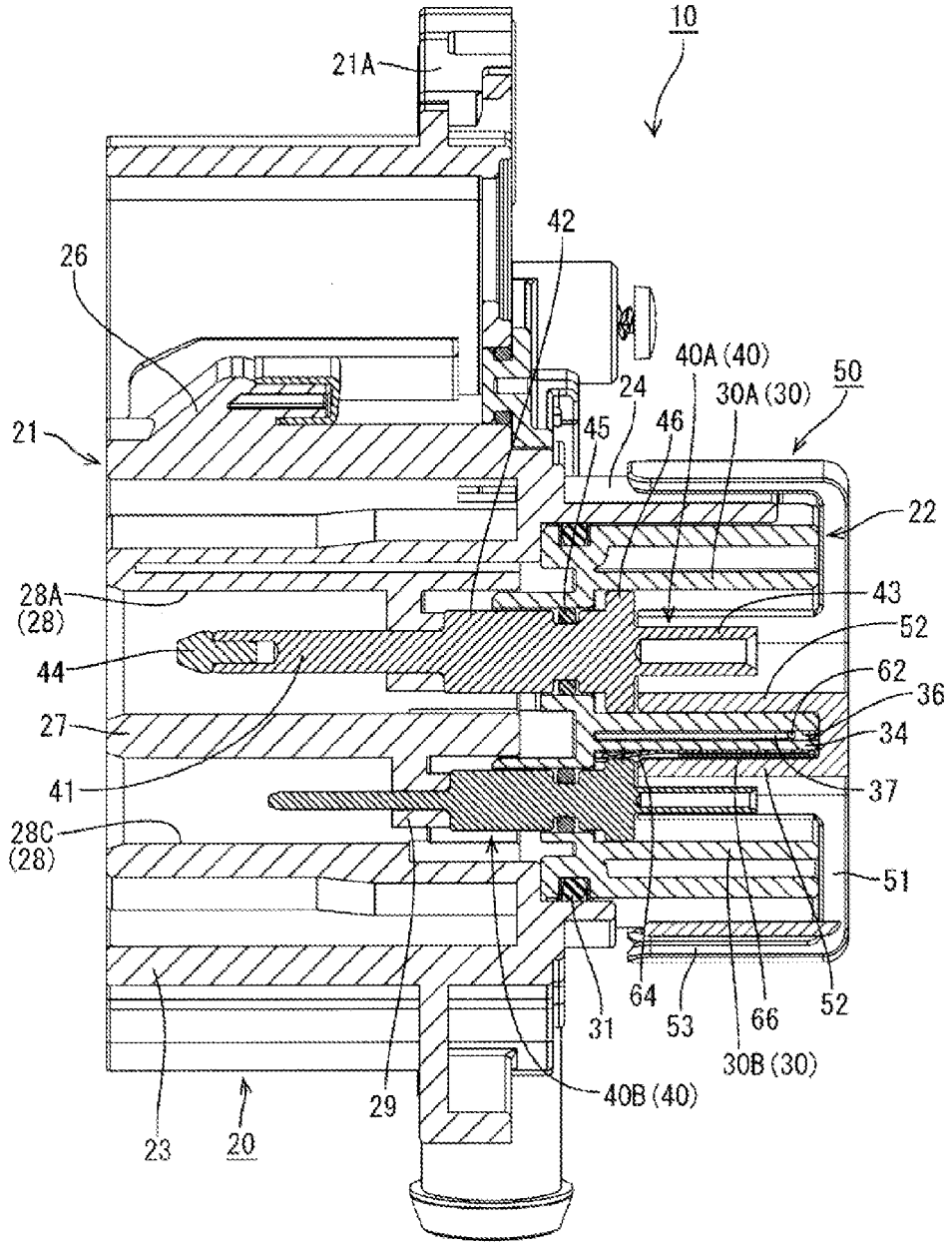
FIG. 4 is a section along A-A of FIG. 3.
Figure 5:
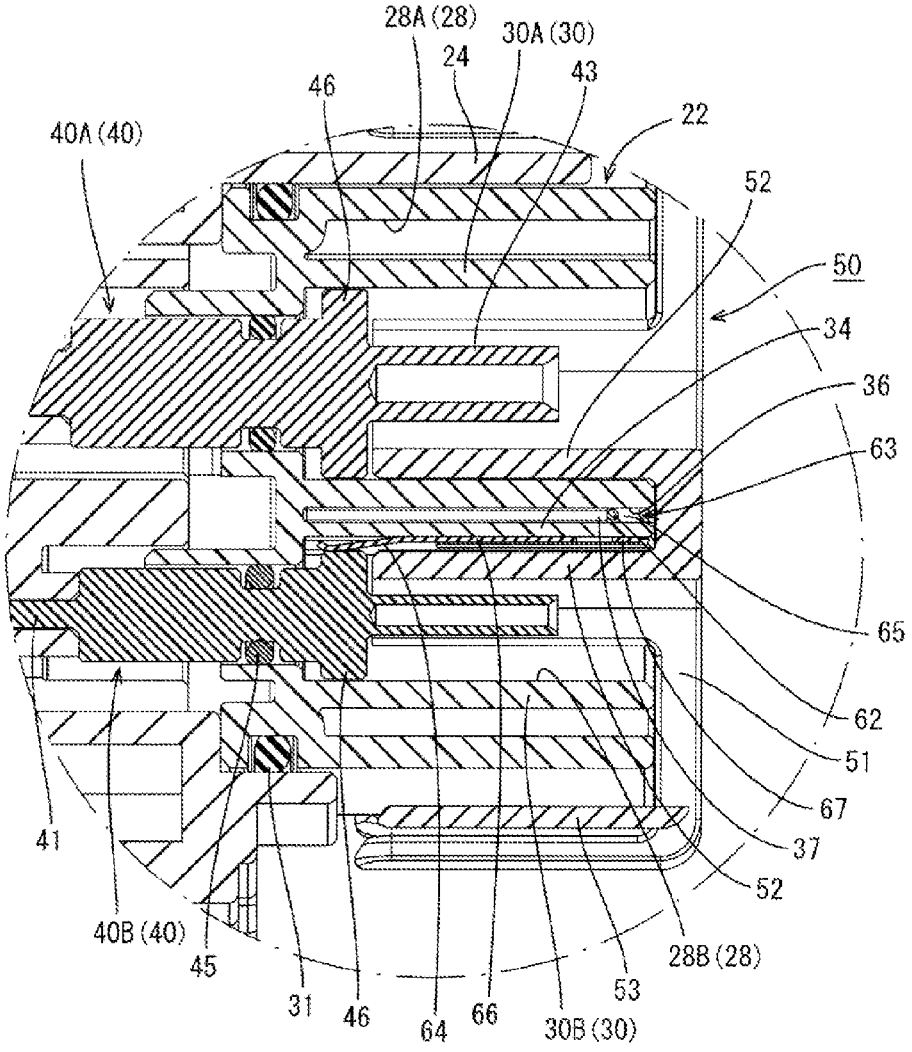
FIG. 5 is an enlarged section of an essential part of FIG. 4.
Figure 6:
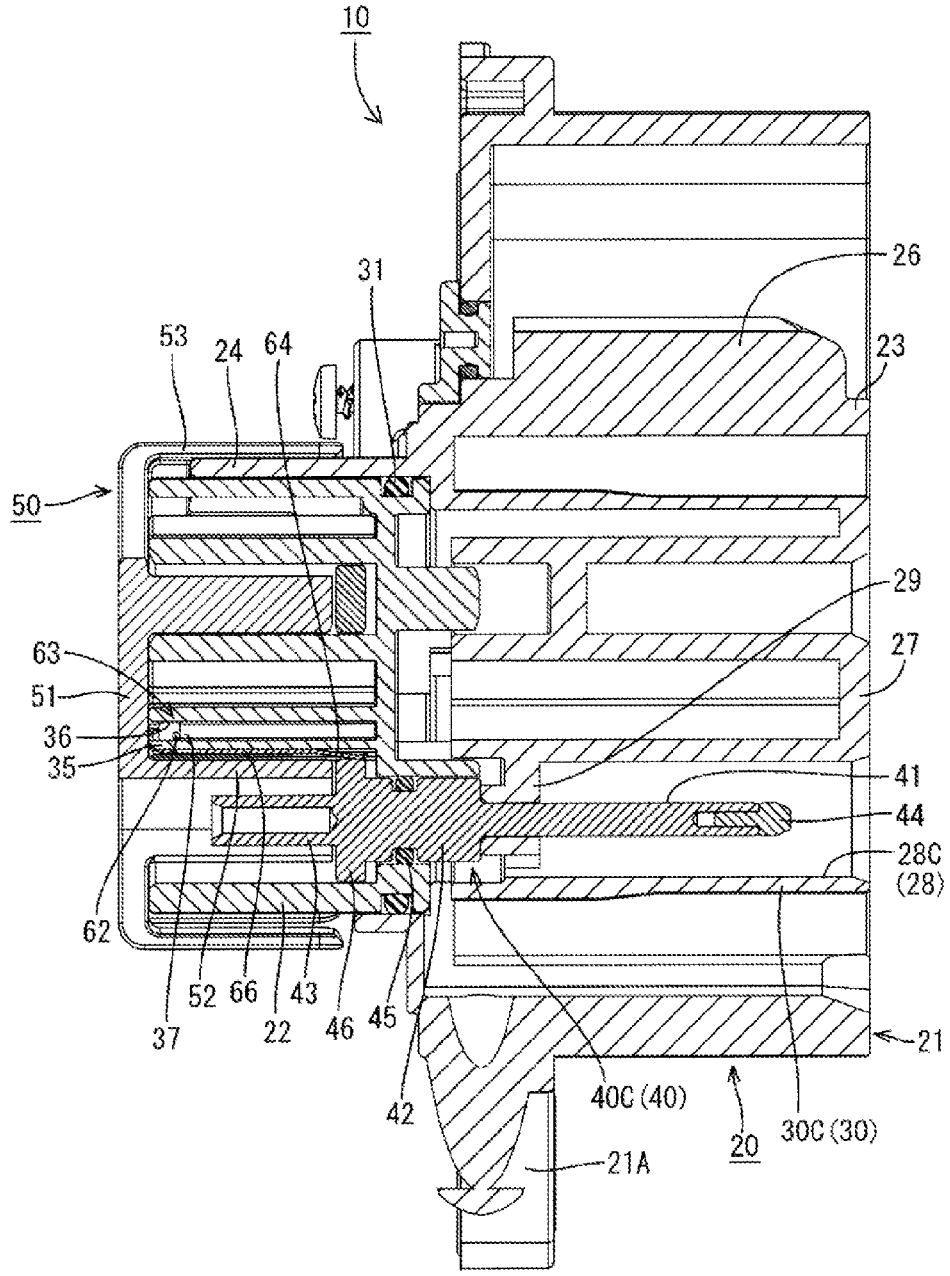
FIG. 6 is a section along B-B of FIG. 3.
Figure 7:
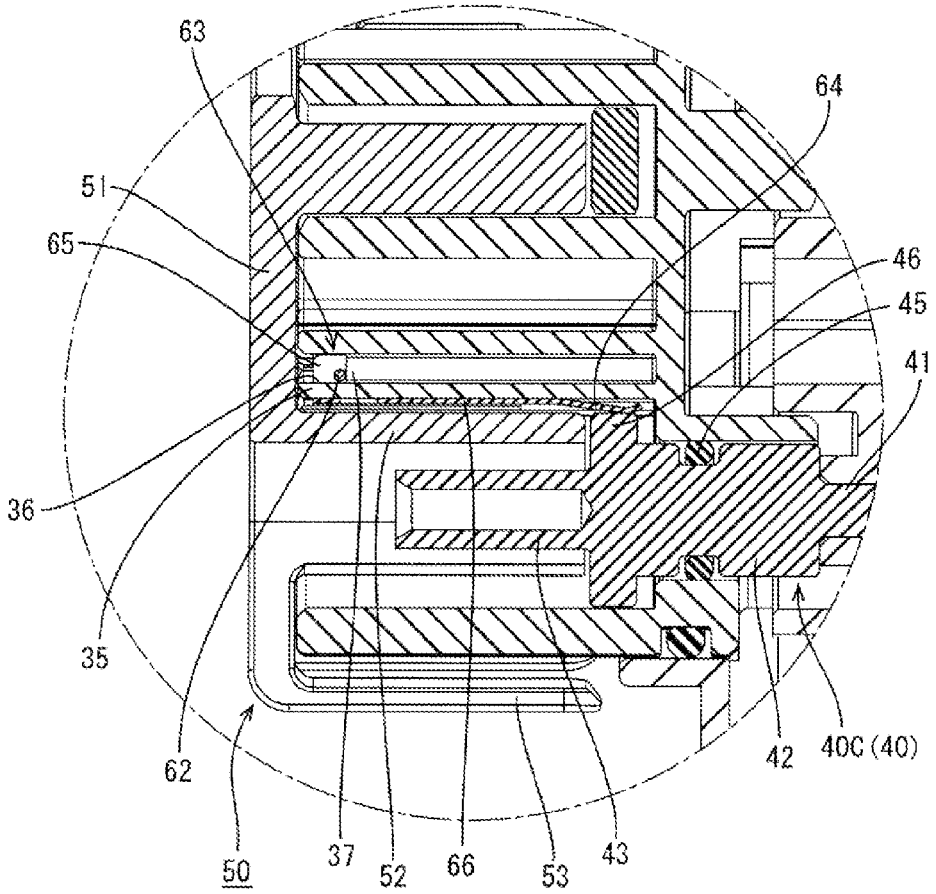
FIG. 7 is an enlarged section of an essential part of FIG. 6.

As shown in FIGS. 4 and 6, the vehicle-side connector 10 includes a housing 20 made of synthetic resin, a plurality of vehicle-side terminals 40 accommodated in the housing 20 and a retainer 50 for collectively retaining the plurality of vehicle-side terminals 40.

As shown in FIGS. 4 and 6, the vehicle-side terminals 40 are roughly in the form of long and narrow round pins and composed of a pair of vehicle-side power supply terminals 40A to be respectively connected to a pair of power supply lines (not shown), a pair of vehicle-side signal terminals 40B to be respectively connected to a pair of signal lines (not shown) and a vehicle-side ground terminal 40C to be connected to a ground line (not shown). Further, the vehicle-side terminals 40 are formed to have a smaller diameter in the order of the vehicle-side power supply terminals 40A, the vehicle-side ground terminal 40C and the vehicle-side signal terminals 40B while having substantially the same shape, and have the same basic configuration.

The vehicle-side terminal 40 is formed by applying heading, cutting and the like to a round metal bar as a base material and includes a pin-like connecting portion 41 to be connected to the charging terminal 83 of the charging connector 80, a main body portion 42 connected behind the pin-like connecting portion 41 and a wire connecting portion 43 connected behind the main body portion 42.

Each pin-like connecting portion 41 is inserted into the corresponding terminal accommodating tube portion 84 of the charging connector 80 to be electrically connected to the charging terminal 83 when the vehicle-side connector 10 and the charging connector 80 are connected. Further, protection caps 44 made of resin are mounted on the tips of some of the pin-like connecting portions 41.

The main body portion 42 is formed into a cylindrical shape having a larger diameter than the pin-like connecting portion 41 and a rubber ring 45 is fitted on the outer peripheral surface of the main body portion 42. Further, a circular flange portion 46 protruding radially outwardly is circumferentially provided on a rear end part of the main body portion 42.

The wire connecting portion 43 is formed into a hollow cylindrical shape with an open rear side, and crimped to a core (not shown) of a wire inserted thereinto.

Figure 8:
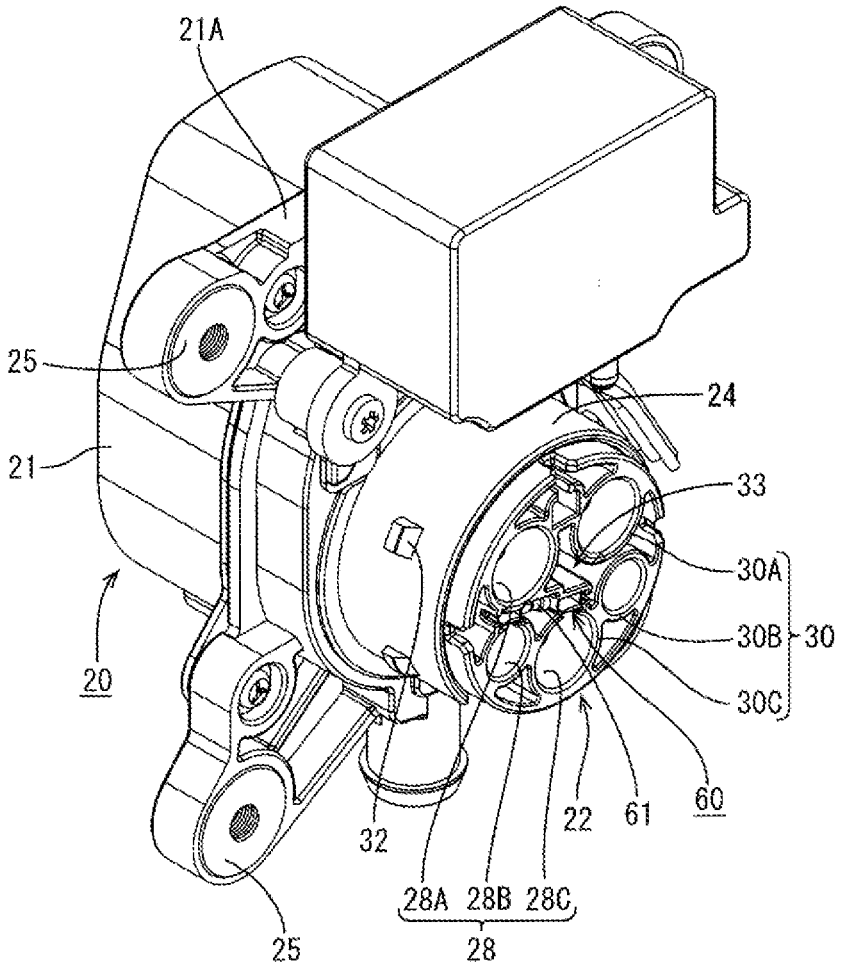
FIG. 8 is a perspective view obliquely viewed from behind showing a state before a retainer is mounted onto a housing.

As shown in FIGS. 4 and 8, the housing 20 is formed by combining a housing main body 21 into which the charging-side fitting portion 81 of the charging connector 80 is to be fitted and a sub-housing 22 to be fitted to the housing main body 21 from behind in the front-back direction.

As shown in FIGS. 1 to 4, the housing main body 21 is provided with a substantially hollow cylindrical connector fitting portion 23, into which the charging-side fitting portion 81 is to be fitted, on the front surface of a mounting plate 21A to be fixed to a body (not shown) of a vehicle and a substantially hollow cylindrical fitting tube portion 24, into which the sub-housing 22 is to be fitted, on the rear surface of the mounting plate 21A.

A plurality of (four in this embodiment) collars 25 are embedded in the mounting plate 21A, and the housing 20 is fixed to the body of the vehicle by inserting bolts (not shown) into these collars 25 and tightening them into the body of the vehicle.

Figure 1:
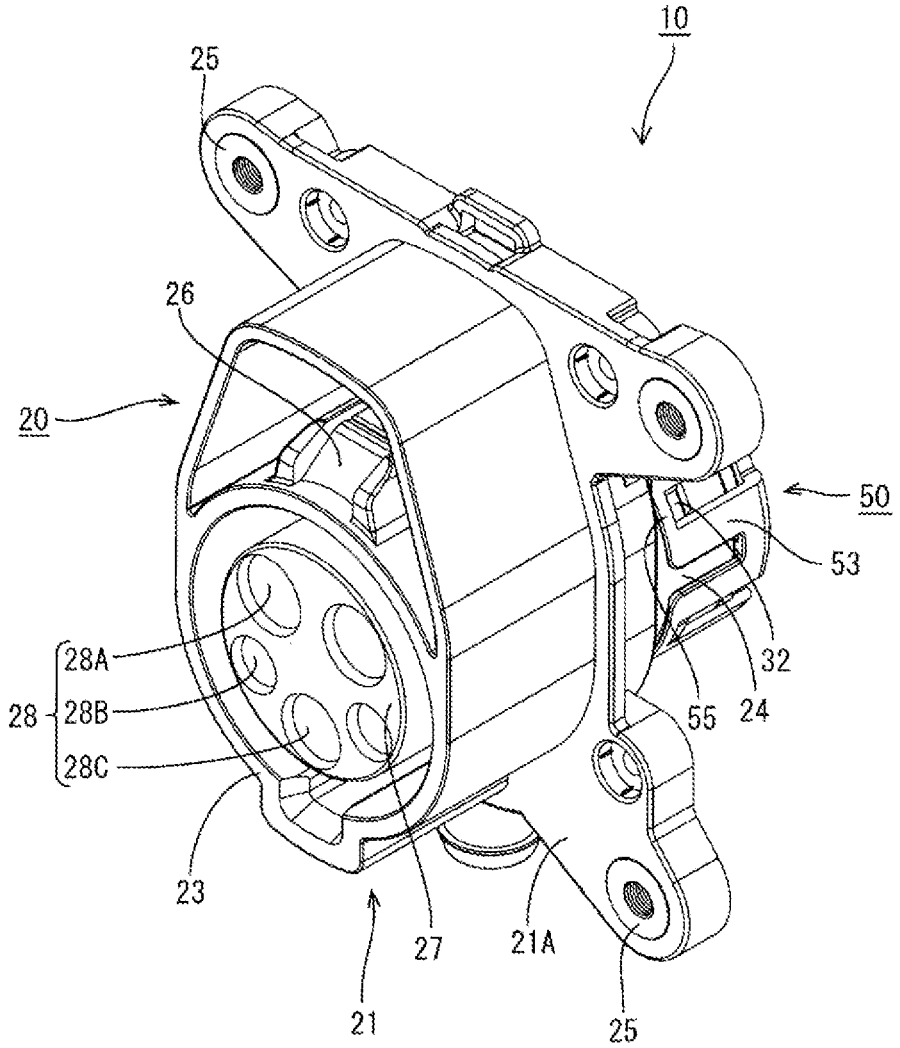
FIG. 1 is a perspective view of a vehicle-side connector obliquely viewed from front.

As shown in FIGS. 1 and 4, a lock portion 26 to which a lock claw 85 (see FIG. 21) provided on the charging connector 80 is locked when the connector fitting portion 23 and the charging-side fitting portion 81 are properly fitted is provided atop the connector fitting portion 23. The lock claw 85 and the lock portion 26 are locked to each other to hold the charging connector 80 and the vehicle-side connector 10 in a connected state.

As shown in FIGS. 1 and 4, a cylindrical terminal accommodating portion 27 connected in the front-back direction to the sub-housing 22 to be fitted into the fitting tube portion 24 is provided in the connector fitting portion 23, and a plurality of cavities 28 common to the terminal accommodating portion 27 and the sub-housing 22 and in the form of round holes are provided to penetrate through the terminal accommodating portion 27 and the sub-housing 22 in the front-back direction.

Figure 10:
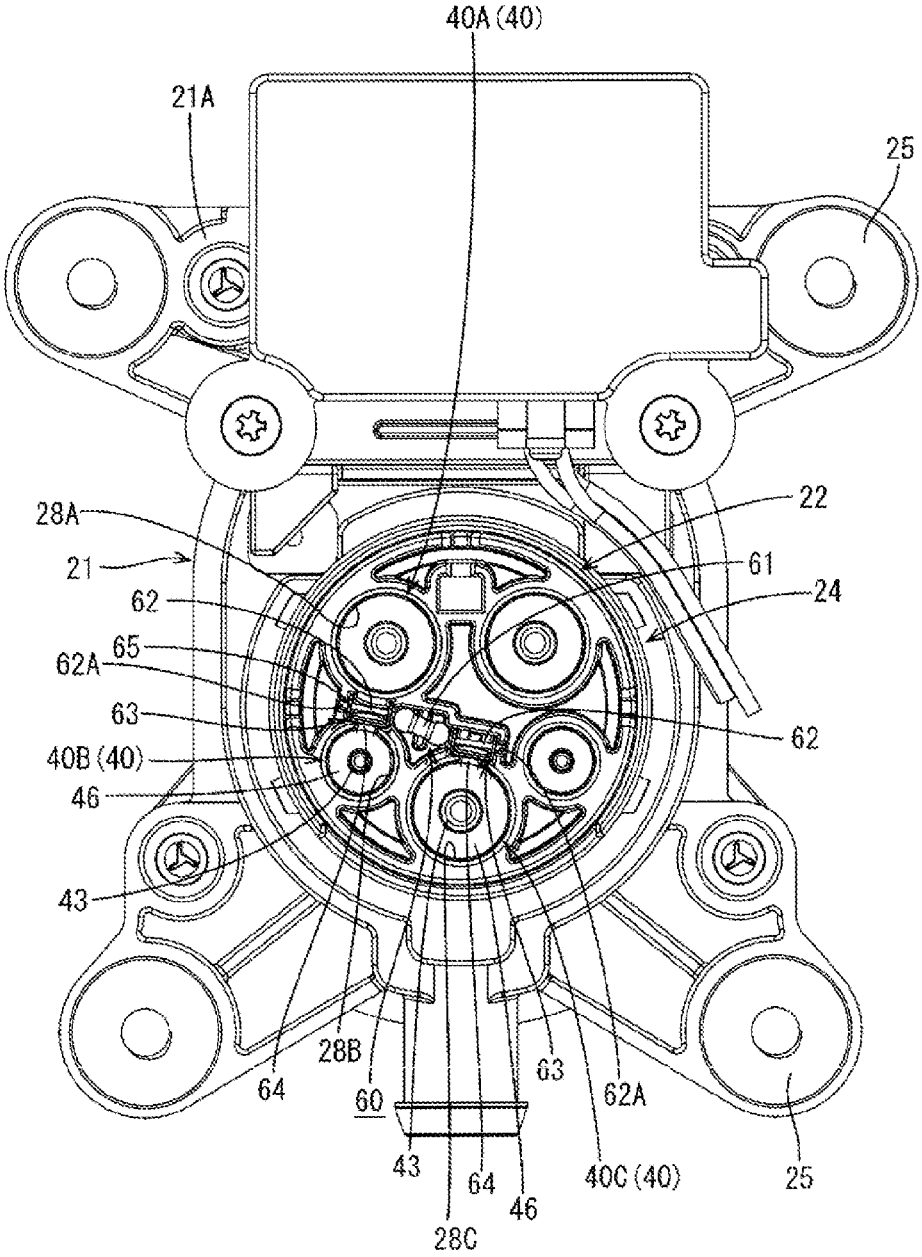
FIG. 10 is a rear view showing the state before the retainer is mounted onto the housing.

As shown in FIG. 10, the plurality of cavities 28 are arranged in three upper, middle and lower rows, wherein a pair of cavities 28 arranged in the upper row are a pair of power supply cavities 28A for accommodating the vehicle-side power supply terminals 40A, a pair of cavities 28 arranged in the middle row are a pair of signal cavities 28B for accommodating the vehicle-side signal terminals 40B and the cavity 28 arranged in the center of the lower row is a ground cavity 28C for accommodating the vehicle-side ground terminal 40C. The corresponding vehicle-side terminal 40 is insertable into each cavity 28 from behind and accommodated over the housing main body 21 and the sub-housing 22 as shown in FIGS. 4 and 6.

As shown in FIGS. 4 and 6, a front stop portion 29 for locking the main body portion 42 of the vehicle-side terminal 40 from front is provided in the cavity 28 of the terminal accommodating portion 27. When each vehicle-side terminal 40 is inserted to a proper position into the cavity 28, the main body portion 42 is locked from front by the front stop portion 29 and the pin-like connecting portion 41 projects from the front stop portion 29.

Figure 11:
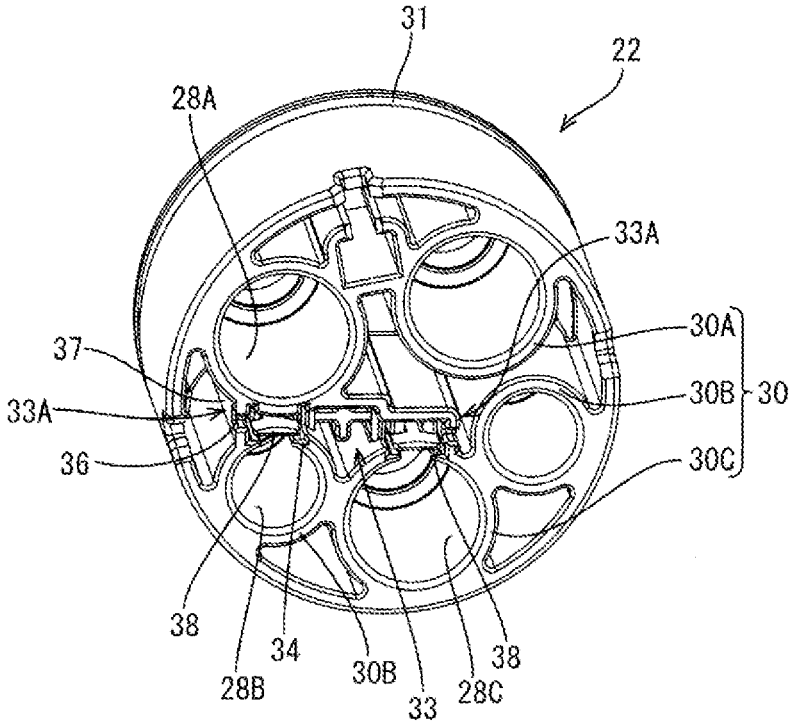
FIG. 11 is a perspective view of a sub-housing.
Figure 12:
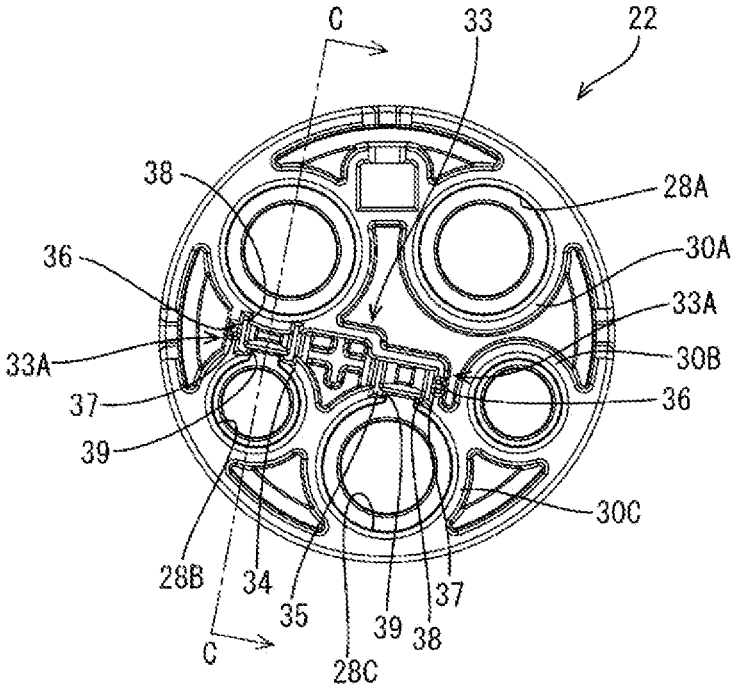
FIG. 12 is a rear view of the sub-housing.

As shown in FIGS. 11 and 12, the sub-housing 22 is formed into a hollow cylindrical shape and a plurality of small-diameter tube portions 30 constituting rear ends of the respective cavities 28 are provided in the sub-housing 22 to have a hollow cylindrical shape. That is, the small-diameter tube portions 30 are provided in three upper, middle and lower rows, wherein those in the upper row are power supply terminal tube portions 30A for accommodating the vehicle-side power supply terminals 40A, those in the middle row are signal terminal tube portions 30B for accommodating the vehicle-side signal terminals 40B and that in the center of the lower row is a ground terminal tube portion 30C for accommodating the vehicle-side ground terminal 40C.

As shown in FIGS. 4 and 6, the main body portion 42 of the corresponding vehicle-side terminal 40 is accommodated into a front part of each small-diameter tube portion 30 and sealing is provided between the outer peripheral surface of the main body portion 42 and the inner peripheral surface of the cavity 28 by the rubber ring 45 fitted on the main body portion 42. Further, an inner diameter of a rear part of each small-diameter tube portion 30 is substantially equal to an outer diameter of the flange portion 46 of the vehicle-side terminal 40 and, as shown in FIGS. 4 to 7, the flange portion 46 is aligned with and inserted into the small-diameter tube portion 30 with a tiny clearance defined between the flange portion 46 and the small-diameter tube portion 30.

A seal ring 31 is fitted on a front end part of the outer peripheral surface of the sub-housing 22. As shown in FIGS. 4 and 6, the seal ring 31 is held in close contact with the inner peripheral surface of the fitting tube portion 24 and the outer peripheral surface of the sub-housing 22 to seal between the housing main body 21 and the sub-housing 22 when the fitting tube portion 24 of the housing main body 21 and the sub-housing 22 are fitted.

The retainer 50 is made of synthetic resin and mountable onto the housing 20 from behind as shown in FIGS. 2 to 7. This retainer 50 includes a base portion 51 for closing a rear end opening of the sub-housing 22, a plurality of retaining portions 52 projecting forward from the base portion 51 and a plurality of mounting pieces 53 projecting forward from the outer peripheral edge of the base portion 51 and arranged along the outer periphery of the fitting tube portion 24.

Each retaining portion 52 is inserted into the corresponding cavity 28 and locks the flange portion 46 of the vehicle-side terminal 40 inserted in the cavity 28 from behind by mounting the retainer 50 onto the housing 20.

The base portion 51 is provided with wire insertion grooves 54 by vertically slotting the base portion 51 from the upper and lower edges, and wires (not shown) drawn out backward from the sub-housing 22 are inserted into these wire insertion grooves 54.

Figure 2:
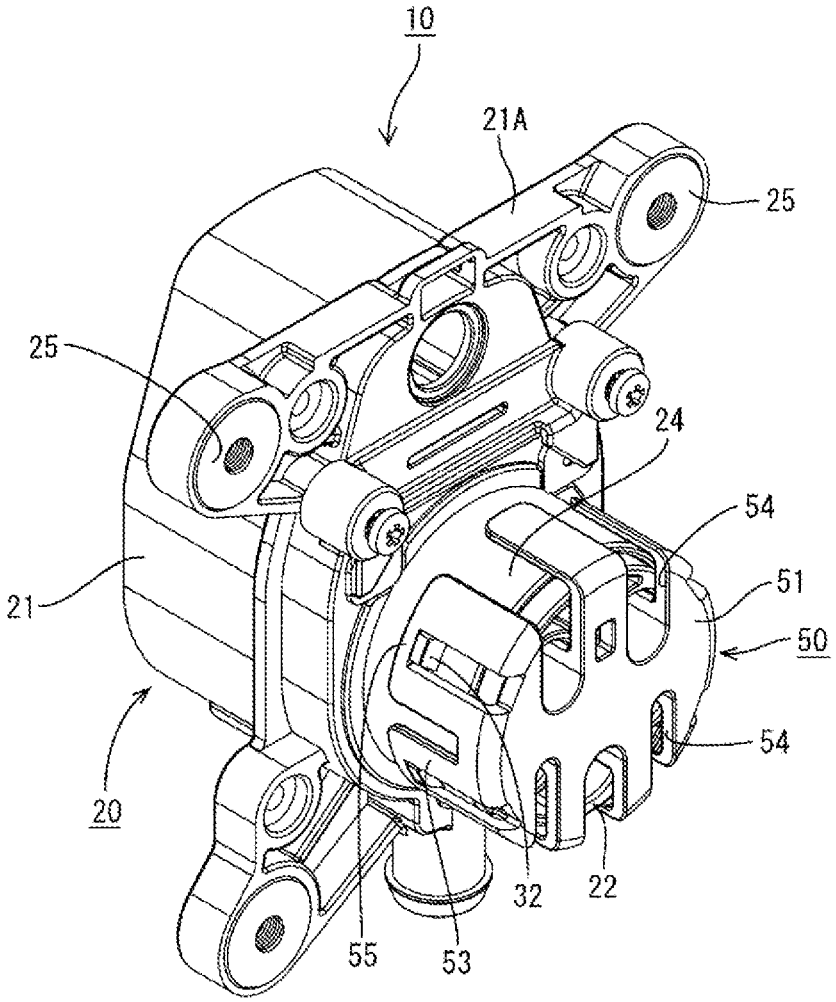
FIG. 2 is a perspective view of the vehicle-side connector obliquely viewed from behind.

Some of the mounting pieces 52 are provided with locking portions 55 capable of individually locking a plurality of locking projections 32 provided on the outer peripheral surface of the fitting tube portion 24. By locking the locking portions 55 and the locking projections 32 in the front-back direction as shown in FIG. 2, the retainer 50 is held on the housing 20. That is, the vehicle-side terminals 40 are prevented from coming out backward in the cavities 28 by holding the retainer 50 on the housing 20.

Figure 9:
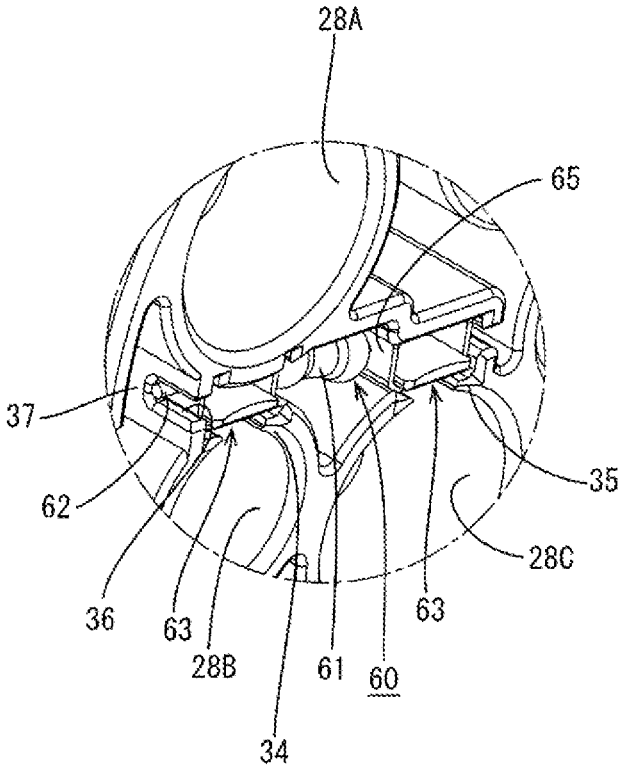
FIG. 9 is an enlarged section of an essential part of FIG. 8.

As shown in FIGS. 8 to 10, an accommodating portion 33 into which a resistance circuit unit (corresponding to a "relay circuit unit") 60 is accommodated from behind is provided on a left side of a rear end part of the sub-housing 22 in a rear view.

Figure 16:
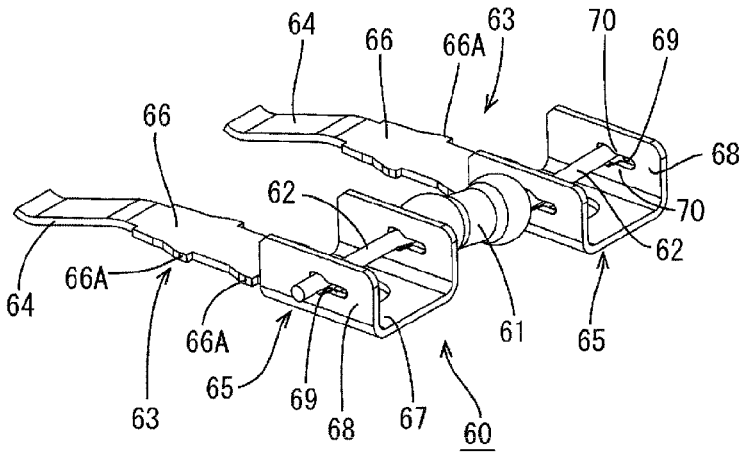
FIG. 16 is a perspective view showing a state before relay terminals and a resistor are connected.
Figure 17:
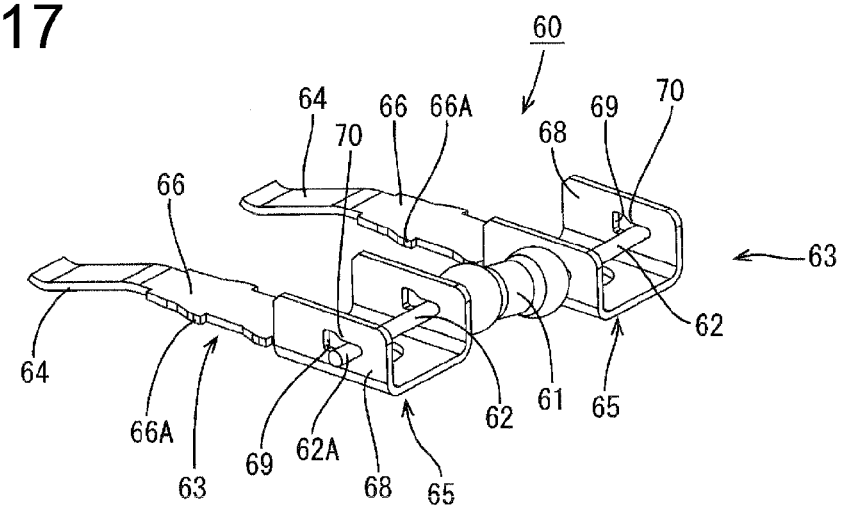
FIG. 17 is a perspective view showing a state after the relay terminals and the resistor are connected.

The resistance circuit unit 60 is mounted by being pushed into the accommodating portion 33 from behind before the vehicle-side terminals 40 are inserted into the sub-housing 22 and includes, as shown in FIGS. 16 and 17, a substantially hollow cylindrical resistor (corresponding to an "electronic component") 61 with a pair of leads 62 provided on opposite end parts, and a pair of relay terminals 63 arranged on opposite left and right sides of the resistor 61 and respectively connected to the leads 62 of the resistor 61. Note that, in this embodiment, the relay terminal 63 arranged on the right side of the resistor 61 corresponds to a first relay terminal and the relay terminal 63 arranged on the left side of the resistor 61 corresponds to a second relay terminal.

Figure 18:
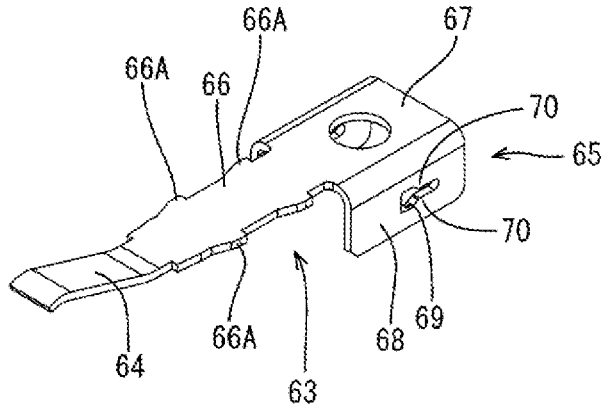
FIG. 18 is a perspective view of the relay terminal.
Figure 19:
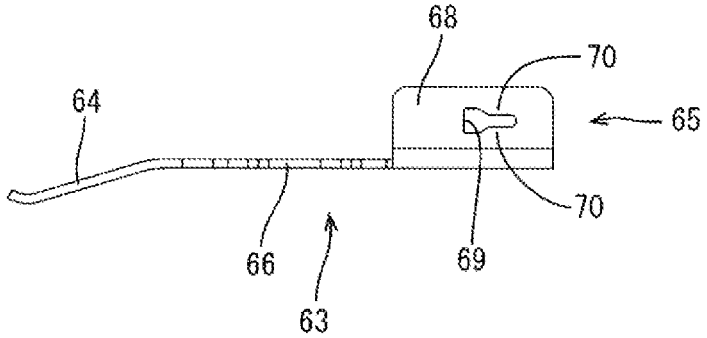
FIG. 19 is a side view of the relay terminal
Figure 20:
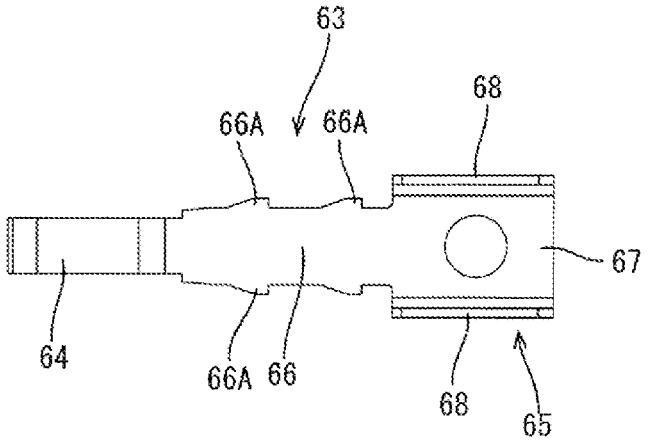
FIG. 20 is a plan view of the relay terminal

As shown in FIGS. 16 and 17, the pair of relay terminals 63 are identically shaped and long in the front-back direction. Further, as shown in FIGS. 18 to 20, each relay terminal 63 includes a terminal connecting portion 64 to be connected to the vehicle-side terminal 40, a lead connecting portion 65 to be connected to the lead 62 and a linking portion 66 linking the terminal connecting portion 64 and the lead connecting portion 65.

The linking portion 66 is in the form of a flat plate long in the front-back direction and pairs of front and rear press-fit projections 66A are respectively provided on opposite side edges of the linking portion 66. The press-fit projection 66A protrudes more outwardly toward a rear side.

The terminal connecting portion 64 extends obliquely downward toward a front side from the front edge of the linking portion 66 and is vertically resiliently displaceable.

The lead connecting portion 65 is connected to the rear edge of the linking portion 66 and formed such that a pair of connecting pieces 68 stand on opposite side edges of a rectangular base plate portion 67 while facing each other in the lateral direction.

Each of the pair of connecting pieces 68 is provided with a lead insertion hole 69 through which the lead 62 is inserted, and the lead 62 can be successively inserted into these lead insertion holes 69 as shown in FIGS. 16 and 17. Further, as shown in FIG. 19, a front part of the lead insertion hole 69 is larger than an outer diameter of the lead 62 and a rear part thereof is smaller than the outer diameter of the lead 62 and a pair of pressure contact blades 70 vertically facing each other are provided on a rear opening edge of the lead insertion hole 69. Thus, each lead 62 of the resistor 61 comes into pressure contact with the pair of connecting pieces 68 of each relay terminal 63 to be electrically connected by being successively inserted through the front parts of the both lead insertion holes 69 of each relay terminal 63 as shown in FIG. 16 and by being pressed between the pressure contact blades 70 as shown in FIG. 17. In this way, the pair of relay terminals 63 are connected via the resistor 61 to construct the resistance circuit unit 60.

Figure 13:
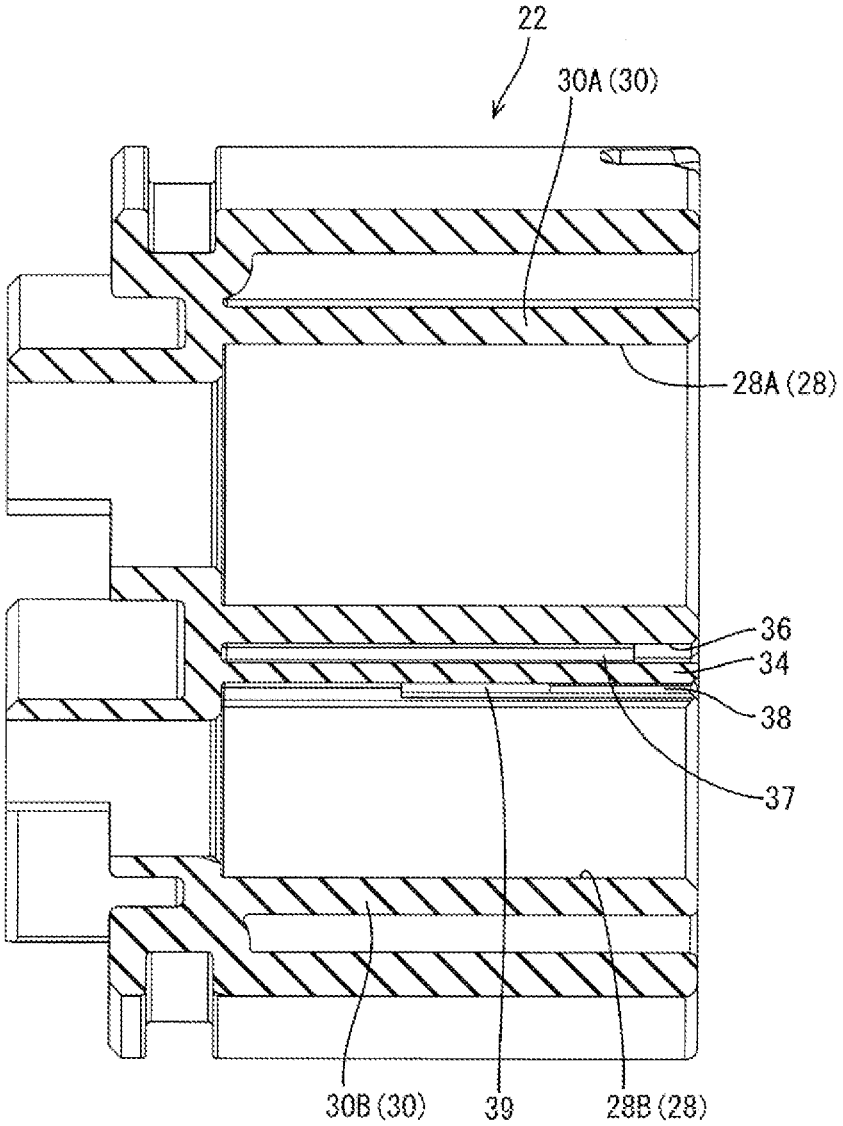
FIG. 13 is a section along C-C of FIG. 12.

On the other hand, as shown in FIGS. 11 to 13, the accommodating portion 33 is open backward and formed into such a substantially rectangular shape long in the lateral direction as to include a lower peripheral wall of the power supply terminal tube portion 30A arranged on the left side, an upper peripheral wall 34 of the signal terminal tube portion 30B arranged on the left side and an upper peripheral wall 35 of the ground terminal tube portion 30C. Further, the resistor 61 of the resistance circuit unit 60 is accommodated in a substantially lateral central part of the accommodating portion 33 and the relay terminals 63 are respectively accommodated in opposite left and right sides of the accommodating portion 33.

Figure 15:
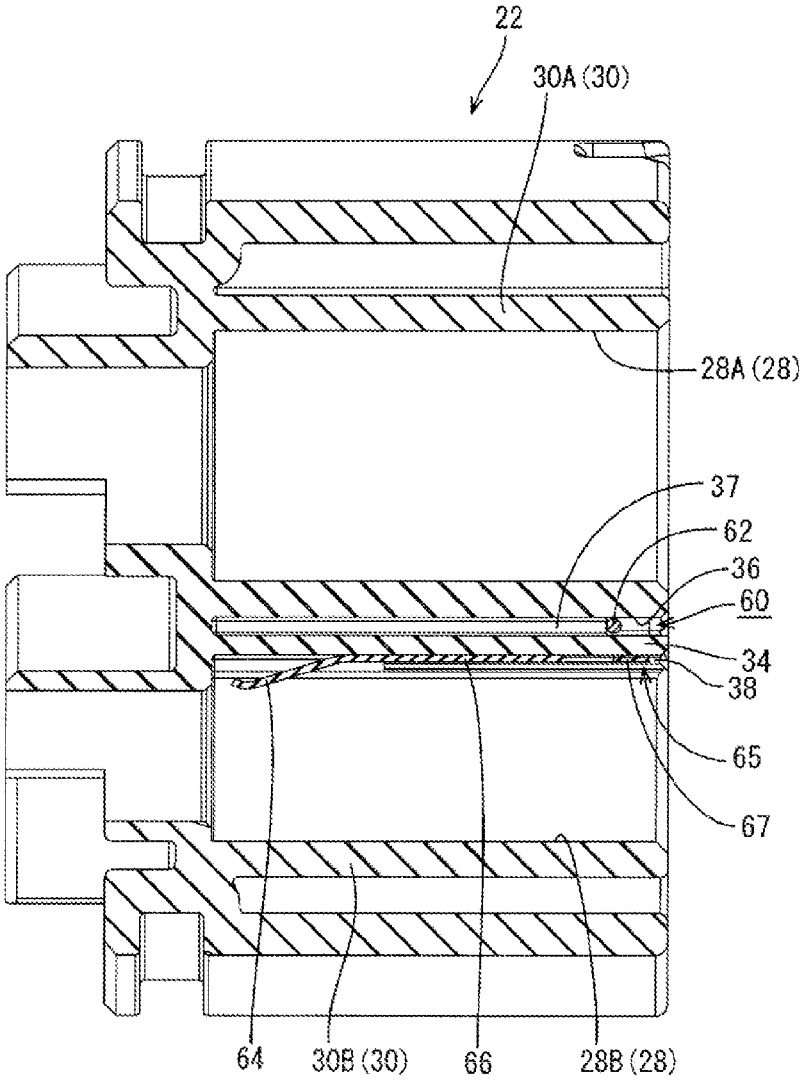
FIG. 15 is a section along D-D of FIG. 14.

Opposite left and right side walls 33A of the accommodating portion 33 are cut forwardly to provide lead insertion grooves 36, and pressing portions 37 for pressing the leads 62 from front are provided on back parts of the lead insertion grooves 36. End parts 62A of the leads 62 located on opposite left and right end parts of the resistance circuit unit 60 are inserted into the lead insertion grooves 36 when the resistance circuit unit 60 is inserted into the accommodating portion 33 from behind and come into contact with the pressing portions 37 from behind when about the halves of the lead connecting portions 65 of the relay terminals 63 are inserted into the accommodating portion 33. When each relay terminal 63 is completely pushed into the accommodating portion 33, the leads 62 are pressed from front by the pressing portions 37 and pushed into between the pressure contact blades 70 of the lead connecting portions 65 as shown in FIG. 15. That is, the leads 62 of the resistor 61 and the lead connecting portions 65 of the relay terminals 63 can be electrically connected only by inserting the relay terminals 63 into the accommodating portion 33.

Figure 14:
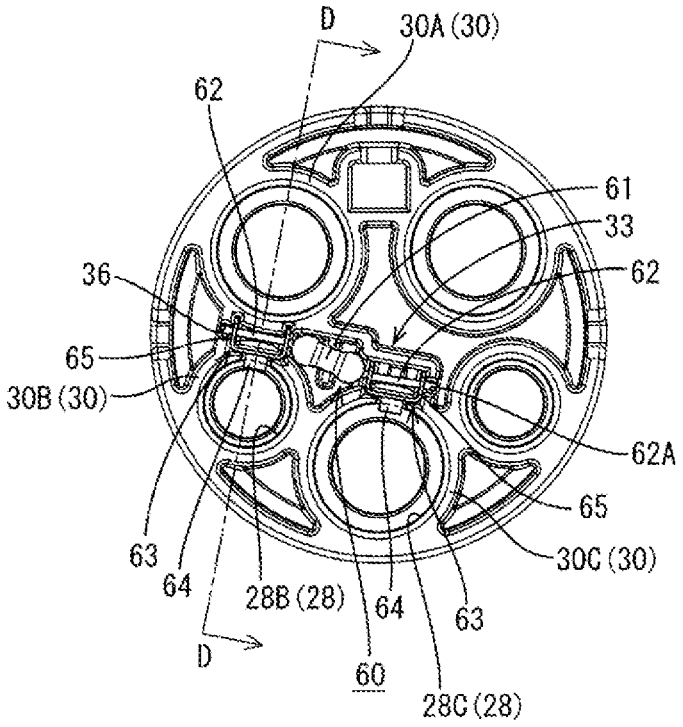
FIG. 14 is a rear view showing a state where a resistance circuit unit is assembled in the sub-housing.

Further, as shown in FIGS. 12 and 13, press-fit recesses 38 into which the relay terminals 63 are inserted from behind are respectively provided in opposite left and right end parts of the accommodating portion 33. A lower end part of the press-fitting recess 38 arranged on the left side is provided inside the upper peripheral wall 34 of the signal terminal tube portion 30B and a substantially lateral central part of the lower end part of the press-fitting recess 38 communicates with the signal cavity 28B in the signal terminal tube portion 30B. Further, a lower end part of the press-fitting recess 38 arranged on the right side is provided inside the upper peripheral wall 35 of the ground terminal tube portion 30C and a substantially lateral central part of the press-fitting recess 38 communicates with the ground cavity 28C. Thus, when each relay terminal 63 is press-fitted into the press-fitting recess 38, the lower surface of the linking portion 66 and the lower surface of the base plate portion 67 in the lead connecting portion 65 are exposed in each cavity 28 and the terminal connecting portion 64 protrudes into an insertion path for the vehicle-side terminal 40 in each cavity 28 as shown in FIGS. 14 and 15.

When the vehicle-side terminal 40 is inserted into each cavity 28 after the resistance circuit unit 60 is inserted into the accommodating portion 33, the flange portion 46 of the vehicle-side terminal 40 comes into contact with the terminal connecting portion 64 of the relay terminal 63 from behind as shown in FIGS. 4 to 7. When the vehicle-side terminal 40 is inserted to a proper position, the tip of the terminal connecting portion 64 moves onto the outer peripheral surface of the flange portion 46 and is resiliently held in contact with the outer peripheral surface of the flange portion 46. In this way, the left relay terminal 63 of the resistance circuit unit 60 and the vehicle-side signal terminal 40B are electrically connected and the right relay terminal 63 of the resistance circuit unit 60 and the vehicle-side ground terminal 40C are electrically connected.

Specifically, the vehicle-side signal terminal 40B and the vehicle-side ground terminal 40C can be electrically connected via the resistance circuit unit 60 by inserting the vehicle-side signal terminal 40B into the signal cavity 28B and inserting the vehicle-side ground terminal 40C into the ground cavity 28C.

Further, press-fit portions 39 into which the press-fit projections 66A of the linking portion 66 are press-fitted are respectively provided in opposite left and right sides of a part where each press-fitting recess 38 and each cavity 28 communicate as shown in FIGS. 12 and 13. Thus, when the relay terminal 63 is press-fitted into the press-fitting recess 38, the press-fitting projections 66A of the linking portion 66 are press-fitted into the press-fitting portions 39, whereby the relay terminal 63 is held in a state press-fitted in the accommodating portion 33. In this way, the resistance circuit unit 60 is held in a state mounted in the sub-housing 22.

The vehicle-side connector 10 of this embodiment is configured as described above. Next, an example of an assembling procedure of the vehicle-side connector 10 is briefly described and functions and effects of the vehicle-side connector 10 are described.

First, the sub-housing 22 and the resistance circuit unit 60 are prepared. Note that the resistance circuit unit 60 in this stage is temporarily assembled by inserting the leads 62 of the resistor 61 into the front parts of the lead insertion holes 69 of the connecting pieces 68 instead of connecting the leads 62 to the connecting pieces 68 in the lead connecting portions 65 of the relay terminals 63 as shown in FIG. 16.

Subsequently, the temporarily assembled resistance circuit unit 60 is inserted into the accommodating portion 33 of the sub-housing 22 from behind. At this time, the terminal connecting portions 64 of the relay terminals 63 are respectively inserted into the press-fitting recesses 38. When the insertion of the lead connecting portions 65 into the press-fitting recesses 38 is started, the end parts 62A of the leads 62 in the resistor 61 are inserted into the lead insertion grooves 36. When about the halves of the lead connecting portions 65 are inserted, the end parts 62A of the leads 62 come into contact with the pressing portions 37 from behind.

If each relay terminal 63 continues to be inserted into the press-fitting recess 38, the lead 62 is pressed from front by the pressing portion 37 and pushed into between the pressure contact blades 70 of the lead connecting portion 65 to be electrically connected to the lead connecting portion 65 as shown in FIG. 15. That is, only by inserting the resistance circuit unit 60 into the accommodating portion 33 from behind, the leads 62 of the resistor 61 and the lead connecting portions 65 of the relay terminals 63 are electrically connected and the resistance circuit unit 60 in which the pair of relay terminals 63 are electrically connected to the resistor 61 can be constructed.

Further, when the resistance circuit unit 60 is completely accommodated into the accommodating portion 33, the press-fit projections 66A on the linking portions 66 of the relay terminals 63 are press-fitted into the press-fit portions 39 of the sub-housing 22 and the resistance circuit unit 60 is held in the sub-housing 22. Then, as shown in FIGS. 14 and 15, the terminal connecting portion 64 of each relay terminal 63 protrudes into the insertion path for the vehicle-side terminal 40 in the corresponding cavity 28.

Subsequently, the sub-housing 22 mounted with the resistance circuit unit 60 is fitted into the fitting tube portion 24 of the housing main body 21 from behind. Then, the seal ring 31 fitted on the outer peripheral surface of the sub-housing 22 is held in close contact with the outer peripheral surface of the sub-housing 22 and the inner peripheral surface of the fitting tube portion 24, thereby sealing between the housing main body 21 and the sub-housing 22.

After the sub-housing 22 is assembled with the housing main body 21, the vehicle-side terminal 40 corresponding to each cavity 28 is inserted from behind. The main body portion 42 of the vehicle-side terminal 40 is locked from front by the front stop portion 29, whereby it can be confirmed that the vehicle-side terminal 40 has been inserted to the proper position. Further, when the vehicle-side terminal 40 is inserted to the proper position, the rubber ring 45 fitted on the main body portion 42 is held in close contact with the inner peripheral surface of the cavity 28 and the outer peripheral surface of the main body portion 42 as shown in FIGS. 4 to 7, thereby sealing between the vehicle-side terminal 40 and the inner peripheral surface of the cavity 28. Here, when the vehicle-side signal terminal 40B is inserted into the signal cavity 28B arranged on the left side and the vehicle-side ground terminal 40C is inserted into the ground cavity 28C, the flange portions 46 of the vehicle-side terminals 40 come into contact with the terminal connecting portions 64 of the relay terminals 63 in the resistance circuit unit 60 from behind at positions behind the proper positions. When the vehicle-side terminals 40 are inserted to the proper positions, the tips of the terminal connecting portions 64 move onto the outer peripheral surfaces of the flange portions 46 and are resiliently held in contact with the outer peripheral surfaces of the flange portions 46 as shown in FIGS. 4 to 7. In this way, the left relay terminal 63 of the resistance circuit unit 60 and the vehicle-side signal terminal 40B are electrically connected and the right relay terminal 63 of the resistance circuit unit 60 and the vehicle-side ground terminal 40C are electrically connected. Specifically, the vehicle-side signal terminal 40B and the vehicle-side ground terminal 40C can be electrically connected via the resistance circuit unit 60.

Finally, the retainer 50 is mounted onto the housing 20 from behind. Then, as shown in FIGS. 4 to 7, the flange portion 46 of the vehicle-side terminal 40 inserted into each cavity 28 is locked from behind by the retaining portion 52. Further, the locking portions 55 of the mounting pieces 53 and the locking projections 32 of the fitting tube portion 24 are locked to each other in the front-back direction. In this way, the retainer 50 is held on the housing 20, the vehicle-side terminals 40 are prevented from coming out backward in the cavities 28 and the vehicle-side connector 10 is completed.

As described above, according to the vehicle-side connector 10 of this embodiment, the pair of leads 62 of the resistor 61 can come into pressure contact with the pressure contact blades 70 provided in the lead connecting portions 65 of the respective relay terminals 63 and the resistor 61 and the relay terminals 63 can be respectively electrically connected only by accommodating the resistance circuit unit 60 into the accommodating portion 33 of the sub-housing 22. Further, the vehicle-side signal terminal 40B and the vehicle-side ground terminal 40C can be respectively electrically connected to the relay terminals 63 only by inserting the vehicle-side signal terminal 40B into the signal cavity 28B and inserting the vehicle-side ground terminal 40C into the ground cavity 28C.

That is, the resistance circuit unit 60 can be easily provided between the vehicle-side signal terminal 40B and the vehicle-side ground terminal 40C as compared with the case where a resistance circuit is provided by soldering or crimping a resistor between wires drawn out from a vehicle-side connector. In this way, man-hours for constructing the resistance circuit can be drastically reduced as compared with the case where the resistance circuit is provided between the wires drawn out from the vehicle-side connector.

Further, according to this embodiment, the lead 62 and the connecting pieces 68 of the lead connecting portion 65 are electrically connected by bringing the lead 62 into pressure contact with the pairs of pressure contact blades 70. Thus, the structure of the lead connecting portion 65 can be simplified and miniaturized, for example, as compared with the case where the lead connecting portion is provided with a resilient contact piece or the like to be resiliently brought into contact with the lead.

Further, according to this embodiment, the relay terminal 63 is held in the sub-housing 22 by providing the press-fit projections 66A on the linking portion 66 linking the lead connecting portion 65 and the terminal connecting portion 64 in the relay terminal 63. Thus, the structure of the relay terminal 63 can be simplified and miniaturized, for example, as compared with the case where a press-fit piece or the like to be press-fitted into the housing is separately provided. Consequently, the resistance circuit unit 60 can be miniaturized.

Since the accommodating portion 33 is provided in a dead space among the cavities 28 in the sub-housing 22 and the miniaturized resistance circuit unit 60 is accommodated in that accommodating portion 33, space saving of the resistance circuit can be realized as compared with the case where the resistance circuit is provided between the wires drawn out from the vehicle-side connector.

Furthermore, according to this embodiment, the relay terminals 63 connected on the left and right sides of the resistor 61 are identically shaped, whereby the relay terminals 63 can be used as common parts. This can prevent the mix-up of the relay terminals 63 and is advantageous in terms of parts management as compared with the case where the relay terminals are differently shaped on the left and right sides.

The present invention is not limited to the above described and illustrated embodiment. For example, the following embodiments are also included in the technical scope of the present invention.

Although the housing 20 is composed of the housing main body 21 and the separate sub-housing 22 in the above embodiment, the present invention is not limited to such a mode. For example, the housing may include the integrally formed housing main body and sub-housing.

Although the vehicle-side signal terminal 40B arranged on the left side and the ground-side signal terminal 40C are connected by the resistance circuit unit 60 in the above embodiment, the present invention is not limited to such a mode. For example, the vehicle-side signal terminal arranged on the right side and the ground-side signal terminal may be connected by the resistance circuit unit.

Although the relay circuit unit is the resistance circuit unit 60 including the resistor 61 in the above embodiment, the present invention is not limited to such a mode. For example, the relay circuit unit may be configured to include an electronic component such as a capacitor or a diode.

LIST OF REFERENCE SIGNS

10: vehicle-side connector
20: housing
28: cavity
33: accommodating portion
37: pressing portion
40: vehicle-side terminal
40C: vehicle-side ground terminal
40B: vehicle-side signal terminal
60: resistance circuit unit (relay circuit unit)
61: resistor (electronic component)
62: lead
63: relay terminal (first relay terminal, second relay terminal)
64: terminal connecting portion
65: lead connecting portion
66: linking portion
66A: press-fit projection
70: pressure contact blade
80: charging connector
83: charging terminal

The invention claimed is:

1. A vehicle-side connector to be connected to a battery mounted in a vehicle, comprising:

a housing configured such that a charging connector is connected thereto;

a plurality of vehicle-side terminals individually accommodated into a plurality of cavities provided in the housing and configured to be individually connected to a plurality of charging terminals provided in the charging connector when the housing and the charging connector are connected; and a relay circuit unit accommodated in an accommodating portion provided in the housing and having one end connected to one of the plurality of vehicle-side terminals and the other end connected to the vehicle-side terminal different from that connected to the one end out of the plurality of vehicle-side terminals, wherein:

the relay circuit unit includes an electronic component with a pair of leads, a first relay terminal to be connected to one of the leads and a second relay terminal to be connected to the other lead; and the leads are pressed by pressing portions provided in the accommodating portion to be respectively connected to lead connecting portions provided on the first and second relay terminals when the relay circuit unit is accommodated into the accommodating portion.

2. The vehicle-side connector according to claim 1, wherein the accommodating portion is provided between the cavities in the housing.

3. The vehicle-side connector according to claim 1, wherein the lead connecting portion includes a pressure contact blade to be brought into pressure contact with the lead pushed by being pressed by the pressing portion.

4. The vehicle-side connector according to claim 1, wherein:

the first and second relay terminals include a terminal connecting portion protruding into the cavity and resiliently displaceable; and the terminal connecting portion resiliently comes into contact with the vehicle-side terminal when the vehicle-side terminal is accommodated into the cavity.

5. The vehicle-side connector according to claim 4, wherein:

the first and second relay terminals include a linking portion linking the lead connecting portion and the terminal connecting portion; and a press-fit projection to be press-fitted into the housing is provided on the linking portion.

6. The vehicle-side connector according to claims 1, wherein:

the electronic component is a resistor;

the vehicle-side terminal to be connected to the first relay terminal is a vehicle-side ground terminal; and the vehicle-side terminal to be connected to the second relay terminal is a vehicle-side signal terminal.

7. The vehicle-side connector according to claims 1, wherein the first and second relay terminals are identically shaped.

* * * * *